United States Patent [19]

Ibbott

[11] 4,088,104

[45] May 9, 1978

[54] DEVICE AND METHOD FOR IMPROVING VAPORIZATION RATE OF VOLATILE FUELS

[76] Inventor: Jack Kenneth Ibbott, 4-17-7 Nishi Azabu, Minato-ku, Tokyo, Japan

[21] Appl. No.: 707,293

[22] Filed: Jul. 21, 1976

Related U.S. Application Data

[63] Continuation-in-part of Ser. No. 610,888, Sep. 5, 1975, abandoned.

[30] Foreign Application Priority Data

Sep. 5, 1975 Japan ..... 50-84885

[51] Int. Cl.[2] ..... F02M 29/00

[52] U.S. Cl. ..... 123/141; 123/135; 48/180 R; 261/78 R

[58] Field of Search ..... 123/141, 135; 48/180 R, 48/180 A, 180 C, 180 M, 180 P, 180 S, 180 H, 180 B, 180 F; 261/78 R

[56] References Cited

U.S. PATENT DOCUMENTS

| | | | |
|---|---|---|---|
| 942,503 | 7/1909 | Jacobs | 48/180 S |
| 1,279,771 | 9/1918 | Snider | 48/180 R |
| 1,295,513 | 2/1919 | Johnson | 48/180 R |
| 1,509,718 | 9/1924 | Depotie | 48/180 R |
| 1,896,786 | 2/1933 | Oppenheim | 48/180 M |
| 2,560,220 | 7/1951 | Graziano | 123/141 |

*Primary Examiner*—Charles J. Myhre
*Assistant Examiner*—Ira S. Lazarus
*Attorney, Agent, or Firm*—Wenderoth, Lind & Ponack

[57] ABSTRACT

A vaporization device is provided which is adapted to be mounted in an intake passage between a carburetor and combustion chambers in an internal combustion engine. The device comprises a porous member partially extending into the intake passage to create a pressure difference between the front up-stream side and the back down-stream side of the porous member wherein the porous member has porosity fine enough to substantially restrict the flow of mixture of air and vaporized fuel therethrough.

10 Claims, 3 Drawing Figures

DEVICE AND METHOD FOR IMPROVING VAPORIZATION RATE OF VOLATILE FUELS

BACKGROUND OF THE INVENTION

This is a continuation-in-part application of U.S. patent application Ser. No. 610,888 filed Sept. 5, 1975, now abandoned.

This invention relates to a device and method for improving the vaporization rate of volatile fuels and, more particularly, to a method and device applied to an intake passage between a carburetor and combustion chambers in an internal combustion engine for vaporizing liquid fuel present in an air-fuel stream delivered from the carburetor.

The vaporization rate of volatile fuels, such as gasoline, to be fed to combustion chambers in an internal combustion engine has an intimate relation to the amount of carbon monoxide CO and hydrocarbon HC to be discharged through an exhaust pipe in an automobile and also to the driving distance of the automobile per unit fuel to be consumed. The discharged carbon monoxide and hydrocarbon cause pollution of air, which, as is well known, is very harmful to human health.

Accordingly, many proposals have been made hitherto to improve the vaporization rate of volatile fuels, such as to provide a screen or coarse porous material extending over the entire transverse area of an intake passage between a carburetor and combustion chambers for breaking up the fuel mixture into a fine spray, thereby atomizing the same as shown in U.S. Pat. Nos. 1,311,071; 1,315,758; 1,443,116; 1,973,889; 2,701,557; and 2,560,220. However, such a screen or coarse porous material could not sufficiently vaporize the fuel mixture to an extent as to notably reduce the discharge of CO and HC due to its coarse structure. On the other hand, if a mass of metallic filaments or woven fine wires such as shown in U.S. Pat. Nos. 1,798,492 and 2,033,753 is made into a dense structure and filled in the intake passage for vaporizing the fuel mixture therethrough, the flow of fuel mixture into the combustion chambers will be severely obstructed and cause considerable loss of power. Accordingly, such structures could not be accepted with satisfaction.

Also, other proposals have been made, such as to adjust the air fuel ratio in response to the engine running speeds or to adjust the temperature of air to be fed into the engine. However, these proposals are complicated in structure, expensive and cause power-down of the engines and are, therefore, not satisfactory in practical use.

Accordingly, an object of the present invention is to provide a device and method for improving the vaporization rate of volatile fuel in internal combustion engines so as to greatly reduce the amount of carbon monoxide and hydrocarbon in an exhaust gas and to increase the driving distance of the automobile per unit fuel to be consumed.

Another object of the present invention is to provide such a device and method which can be applied very easily to any type of automobile now in use.

A further object of the present invention is to provide such a device which is very simple in structure and inexpensive to manufacture.

BRIEF SUMMARY OF THE INVENTION

It has been found by the present inventor that air and vaporized fuel delivered from a carburetor into an intake passage flow through the axial center part of the passage, while fuel still in the liquid state drains down or flows along the inner periphery of the passage. The air and vaporized fuel are intimately mixed together, and it is not desirable to pass such air-vapor mixture through any vaporization device in view of the restricted flow caused therethrough. On the basis of such findings the inventor has developed a method and device for effectively vaporizing only the liquid fuel without substantially obstructing the smooth flow of the mixture of air and vaporized fuel. During extensive tests for this purpose, the inventor developed the use of porous material and has conducted further tests using the porous materials.

First, an absorption test was made using rods of porous material approximately 5mm square and about 30mm long. Each rod was made of Plaster of Paris to have a different porosity. These rods were all set standing vertically in a tray containing gasoline having a depth of about 5mm. The time taken for the gasoline to absorb up the full length of the rod was measured, and the rod having the finer porosity took the shorter time for the absorption. Then, these gasoline saturated rods were individually subjected to a vapor release test by measuring the intensity of hydrocarbon vapor released from each rod when a hydrocarbon gas sensor was set at a standard distance from the gasoline saturated rod.

Following this an ignition test was made by placing a lighted match near each rod and noting the distance at which ignition would occur. Using these vapor release and ignition tests it was found that the porous rod which had the fastest absorption rate also released the greatest amount of gasoline vapor, and also the same test rod would ignite when the match was placed at the farthest distance away. In the case of the fast absorption rod ignition would occur while the lighted match was still within a few millimeters of the rod, thus, proving a high release of combustible gasoline vapor.

In these tests, it could be noted that the porous material having a fine porosity showed strong capillary action to fastly absorb the volatile liquid fuel, to strongly retain the liquid fuel and to fastly release the fuel in a vapor state, and that the porous material having a porosity fine enough to substantially restrict the flow of mixture of air and vaporized fuel therethrough would be most desirable for use in the present device. For this purpose, preferable porosity of the porous material was less than about $12\mu$.

The present vaporization device provided on the basis of the above facts comprises a tubular member having a peripheral wall defining an axial open passage therethrough, the peripheral wall being made of porous material having porosity of less than about $12\mu$. Preferably, the tubular member has an inverted frusto-conical shape.

When the present device is mounted in an intake passage between a carburetor and combustion chambers in an internal combustion engine, the porous member of the device partially extends into the intake passage, preferably, from the inner periphery thereof and has a porosity fine enough to substantially restrict the flow of mixture of air and vaporized fuel therethrough.

As the air-fuel stream delivered from the carburetor contains a portion of the fuel which is still in the liquid state and some fuel which is in the vapor state, that portion of the air-fuel stream carrying the mixture of air and fuel vapor will freely pass or be by-passed by the porous member into a free space in the intake passage where the porous material does not extend and drawn at a relatively high velocity therethrough, thereby causing a difference in pressure on the front up-stream side and the back down-stream side of the porous member. The back down-stream side of the porous member having a lower pressure will cause the liquid state fuel of relatively low velocity being readily absorbed into the front side of the porous member to pass through the porous member to the back side thereof and be fastly released from the back side in the vapor state and then enter into the air-fuel stream at a position down-stream of the intake passage.

Accordingly, only the liquid fuel in the air-fuel stream is absorbed and then released from the porous material in the vapor state, while the mixture of air and vaporized fuel passes through the free space, so that not only the vaporization rate of the volatile fuel is improved but also the flow of the air-fuel stream is smooth.

The present method for improving the vaporizations rate of volatile fuel delivered from a carburetor into an intake passage comprises creating a pressure difference in the passage by a porous member partially extending into the passage, flowing a liquid fuel portion contained in the air-fuel stream from the carburetor into the porous member while flowing the mixture of air and vaporized fuel in the air-fuel stream to the free space of the passage where it is free from the porous member, vaporizing the liquid fuel portion through the porous member, and releasing the vaporized fuel from the porous member into a position down-stream of the passage.

The material from which the porous member of the present device is formed may be any type of porous material, medium or substance such as sintered metal particles, Plaster of Paris, gypsum, ceramic, etc. However, the porosity of the porous material has to be fine enough to substantially restrict the flow of the mixture of air and vaporized fuel therethrough and to allow the mixture to be by-passed into a free space. As set forth above, it has been noted by tests that the preferable porosity of the porous material is less than $12\mu$.

Ideal places for mounting the present device are in the intake passage between the carburetor and intake manifold and between the intake manifold and the engine block.

The aforementioned and other objects and features of the present invention shall be described hereinafter in detail with reference to a preferred embodiment thereof shown in the accompanying drawings, in which:

DETAILED DESCRIPTION OF THE INVENTION

Figure 1:
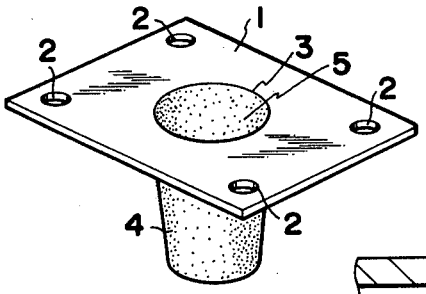
FIG. 1 is a perspective view showing a device according to a preferred embodiment of the present invention.

Referring to FIG. 1, a rectangular shaped mounting plate 1 made of metal or such is provided with four holes 2 at the corners thereof and a circular opening 3 at the center portion thereof. Attached inside of the circular opening 3 and extending therefrom below the plate 1 is a tubular and inverted frusto conical shaped thin porous member 4 having a porosity fine enough to substantially restrict the flow of air and vaporized fuel therethrough. The preferable porosity of member 4 is less than $12\mu$. Formed and surrounded by the porous member 4 is an axial opening 5, the diameters of which are gradually reduced as it extends downwardly. Preferably, the diameter at the upper end of the opening 5 is made substantially equal to that of the intake passage at the position of mounting of the present device, the intake passage connecting a carburetor to combustion chambers in an engine.

FIG . 2 shows the present device mounted between a carburetor 6 and intake manifold 7 by bolts 8 passing through holes 2 in the mounting plate 1 and aligned connecting holes in the carburetor 6. The diameter at the upper end of the axial opening 5 is substantially the same as that of the passage 9 in the carburetor 6. The inverted frusto-conical shaped porous member 4 extends downwardly into the intake manifold 7 with circumferential narrow annular space 10 between the outer surface 11 of the porous member 4 and the inner surface 12 of the intake passage in the intake manifold 7.

Figure 2:
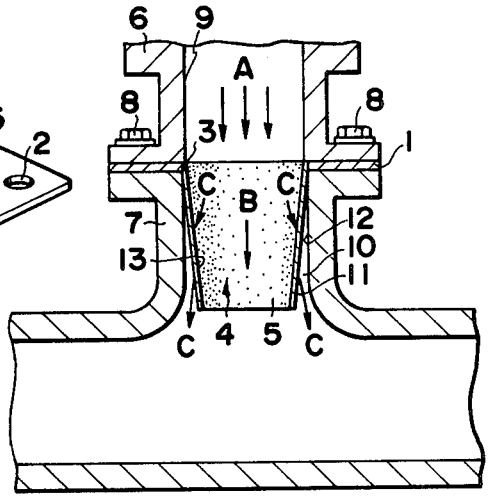
FIG. 2 is a vertically sectioned front view showing the present device of the type shown in FIG. 1 mounted between a carburetor and an intake manifold.

With such an arrangement in FIG. 2, when the engine starts running, an air-fuel stream is delivered from the carburetor 6 into the intake manifold 7 as shown by arrow A. The air-fuel stream delivered by the carburetor 6 contains a portion of the fuel which is in the vapor state. Such vaporized fuel portion and air flow through the axial center part of the intake passage 7 due to the lighter weight thereof and are drawn through the axial center part thereof, while that portion of the fuel which is still in the liquid state drains down or flows along the inner periphery of the intake passage due to its heavy weight and is drawn along it at a relatively lower speed. When the mixture of air and vaporized fuel is drawn through the axial opening 5 surrounded by the porous member 4 of the present device as shown by arrows B, there is produced a difference in pressure on the front up-stream side or inner side 13 of the porous member 4 facing the air-fuel stream and the back down-stream side or outer side 11 of the porous member 4 facing the circumferential annular space 10. The back side 11 of the porous member 4 having a lower pressure causes the liquid fuel, which is drawn at a relatively lower speed into the intake manifold 7 along the inner periphery of the intake passage, to be absorbed into the porous member 4 from the front side thereof as shown by arrows C. The absorbed liquid fuel is vaporized in the porous member while being drawn through the porous member by the lower pressure and released into the peripheral space 10 from the outer side 11 of the porous member in the vapor state. The vaporized fuel in the peripheral space 10 is intimately mixed with the mixture of air and vaporized fuel drawn through the axial opening 5 in the device and then fed into combustion chambers in the engine. In such an operation, the porous member 4 has so fine a porosity as to substantially restrict the flow of air and vaporized fuel therethrough, so that the mixture of air and vaporized fuel coming to the inner side of the porous member is by-passed to the axial center opening of the porous member and flows therethrough.

Figure 3:
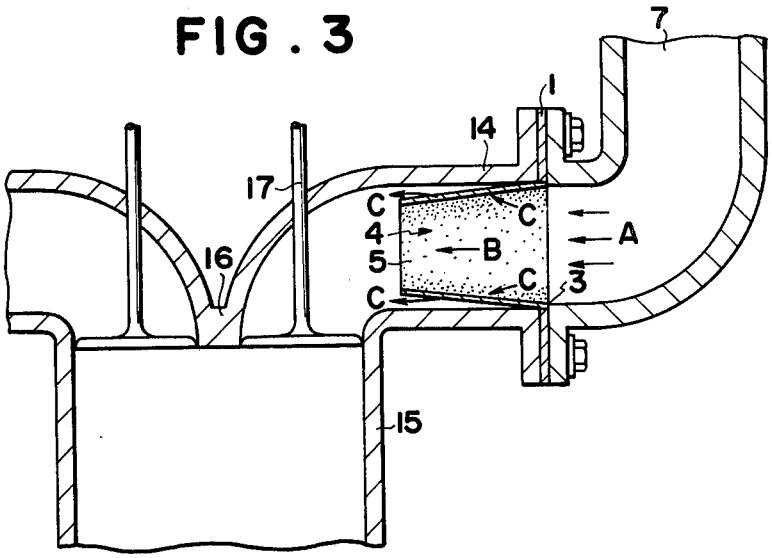
FIG. 3 is a vertically sectioned front view showing the present device of the type shown in FIG. 1 mounted between the intake manifold and an engine block.

As shown in FIG. 3, the present device may be mounted between the intake manifold 7 and the engine block 14. Also, the present devices may be mounted at both places, i.e., between the carburetor 6 and the intake manifold 7 and between the intake manifold 7 and the engine block 14. The functions of the present device mounted between the intake manifold 7 and the engine block 14 as shown in FIG. 3 are the same as those set forth in connection with FIG. 2. In FIG. 3, the air-fuel stream drawn through the present device is fed into a combustion chamber 15 through a cylinder head 16 and valve 17 in the engine.

The present device of the type shown in FIG. 1 was subjected to tests to check CO and HC emissions in the exhaust gas and driving distance per unit of fuel. The tests were carried out using a 1600 cc Isuzu Florian engine with and without the present device. The present device used was of the type shown in FIG. 1 in which the porous material of the inverted frusto-conical shaped porous member 4 was Plaster of Paris having porosity of about 2$\mu$, and the dimensions thereof were as follows:

Diameter of large part—30 mm approx.
Diameter of small part—23 mm approx.
Height of the wall—40 mm approx.
Thickness of the wall—1 mm approx.

In the tests, gas sensors for CO and HC were installed in the car, and meters reading the relative amounts of each gas were installed in front of the driver to show instant readings of gas emission under the particular driving conditions. These meter readings were only relative and did not show actual percentages, parts per million, or grms/kilometer.

A meter showing an instant reading of kilometers/-liter was also installed and in this case the meter was accurately calibrated and showed actual readings of kilometers/liter.

| | Test Results | |
|---|---|---|
| | without the present device (meter readings) | with the present device (meter readings) |
| CO emission | | |
| engine idling | 3 | 3 |
| driving (40 km/hour) | $10^+$ | 4 to 5 |
| HC emission | | |
| engine idling | 3 | 3 |
| accelerating | $10^+$ | 6 |
| driving (40 km/hour) | 9 | 4 to 5 |
| Kilometers/liter (city driving) | 7 to 8 | 10 to 11 |

In the above table, the meter reading shown as $10^+$ means that the meter indicator had passed the maximum reading and was hard against the stop. These readings could have been in the order of 15 or more could the meter scale have been extended.

As it is shown in the table, if the CO and HC emission when the engine was idling showed no change, however considerable cutting of the CO and HC emission was obtained under driving conditions. The driving distance of the automobile per liter of gasoline was remarkably increased.

There was also an impressive increase of engine power, unfortunately no instruments were available to measure this however, the effect was most obvious when driving, faster acceleration, easier driving up steep hills.

As is apparent from the disclosure and the test results, according to the device of the present invention, some liquid fuel carried by the air-fuel stream is vaporized through the porous material and the vaporized fuel intimately mixed with air-fuel stream, so that the air-fuel mixture fed into the combustion chamber in the engine will be almost completely burnt with the result that the emissions of CO and HC in the exhaust gas are remarkably reduced and that the driving distance of the automobile using the present device is increased per unit of fuel.

Although the present invention has been described with reference to the preferred embodiment thereof, many modifications and alterations may be made, and especially the shape and dimensions of the present device may be varied in accordance with the shape and dimensions of the intake passage between the carburetor and the combustion chambers and with the capacity and performance of the engines.

Also it should be pointed out that the device may be of any shape, disc, portion of disc, square or rectangular plate, etc., made of the porous material and placed in the path of the air-fuel stream in the intake passage between the carburetor and combustion chambers in such a manner as to cause a pressure difference between the front up-stream side and back down-stream side of the porous material device and such device partially extends in the intake passage or is small enough to permit the free flowing of most of the air-fuel stream.

What I claim is:

1. A vaporization device for use in an intake passage between a carburetor and combustion chambers in an internal combustion engine, said device comprising a tubular member having a peripheral wall defining an axial open passage therethrough, said peripheral wall being made of porous material having porosity of less than 12$\mu$, said porosity being insufficient to allow passage through said wall of air and gaseous fuel.

2. A vaporization device as claimed in claim 1, wherein said tubular member has an inverted frusto-conical shape in which said axial open passage defined by said peripheral wall has an open larger end and an open smaller end.

3. A vaporization device as claimed in claim 1, further comprising a mounting plate provided with an opening therethrough to which said tubular member is connected.

4. An assembly comprising:

an intake passage connecting a carburetor and combustion chambers of an engine, with an air-fuel stream flowing through said intake passage from said carburetor to said combustion chambers, said stream during flow through said intake passage containing vaporized fuel which combines with air to form a mixture flowing through said intake passage at a relatively high velocity and a liquid fuel portion which flows along the inner periphery of said intake passage at a relatively low velocity;

means positioned within said intake passage for vaporizing said liquid fuel portion, said vaporizing means comprising a porous member extending from said inner periphery of said intake passage across a relatively small portion only of said intake passage, while leaving the majority of said intake passage unobstructed;

said porous member having a porosity fine enough to prevent passage therethrough of said air and vaporized fuel mixture, whereby said porous member performs as means for forcing said mixture to pass completely through the unobstructed major portion of said intake passage and to create a pressure difference between the front up-stream side and the back down-stream side of said porous member; and said porosity being such as to allow said porous member to absorb said liquid fuel portion, whereby said pressure difference causes the thus absorbed fuel to be drawn through said porous member and released from said down-stream side thereof as vaporized fuel.

5. An assembly as claimed in claim 4, wherein said porous member has a relatively wide opening formed through the axial center thereof, said opening forming said unobstructed major portion of said intake passage.

6. An assembly as claimed in claim 4, wherein said porous member extends from said inner periphery of said intake passage in a direction axially and slightly inwardly of said intake passage, there being a narrow annular space between said inner periphery of said intake passage and the outer surface of said porous member.

7. An assembly as claimed in claim 4, wherein said porous member is a tubular member having an inverted frusto-conical configuration with an open larger end and an open smaller end, the diameter of the opening at said larger end being substantially equal to the inner diameter of said intake passage at the position therein whereat said porous member is mounted.

8. An assembly as claimed in claim 4, wherein said porosity is less than $12\mu$.

9. An assembly as claimed in claim 4, wherein said porous member is formed of sintered metal particles, and said porosity is less than $12\mu$.

10. A method for improving the vaporization rate of volatile fuel delivered from a carburetor into an intake passage of an engine, said method comprising:

delivering an air-fuel stream from a carburetor into an intake passage, said stream containing vaporized fuel combined with air to form a mixture flowing through said intake passage at a relatively high velocity and a liquid fuel portion which flows along the inner periphery of said intake passage at a relatively low velocity;

providing a porous member within said intake passage such that said porous member extends from said inner periphery of said intake passage across a relatively small portion only of said intake passage, while maintaining the majority of said intake passage unobstructed, said porous member having a porosity fine enough to prevent passage therethrough of said air and vaporized fuel mixture;

passing said air and vaporized fuel mixture through the unobstructed major portion of said intake passage, while preventing passage of said mixture through said porous member, and creating a pressure difference between the front upstream; side and the back down-stream side of said porous member; and passing said liquid fuel portion from said inner periphery of said intake passage into said porous member, vaporizing said liquid fuel portion through said porous member, and releasing the thus vaporized fuel from said porous member into said intake passage at the down-stream side of said porous member, due to said pressure difference.

* * * * *